US007056133B2

(12) United States Patent
Iwasaki

(10) Patent No.: US 7,056,133 B2
(45) Date of Patent: Jun. 6, 2006

(54) SURFACE MOUNTING CONNECTOR

(75) Inventor: Masaaki Iwasaki, Kanagawa (JP)

(73) Assignee: Tyco Electronics Amp K.K., Kanagawa-Ken (JP)

( * ) Notice: Subject to any disclaimer, the term of this patent is extended or adjusted under 35 U.S.C. 154(b) by 0 days.

(21) Appl. No.: 10/913,198

(22) Filed: Aug. 6, 2004

(65) Prior Publication Data

US 2005/0032420 A1 Feb. 10, 2005

(30) Foreign Application Priority Data

Aug. 6, 2003 (JP) ..... 2003-287881

(51) Int. Cl.
*H01R 12/00* (2006.01)

(52) U.S. Cl. ..... 439/83

(58) Field of Classification Search ..... 439/83, 439/570, 571, 546, 548
See application file for complete search history.

(56) References Cited

U.S. PATENT DOCUMENTS 4,436,358 A * 3/1984 Coldren et al. ..... 439/83
6,050,851 A * 4/2000 Kajiura et al. ..... 439/570
6,305,976 B1 * 10/2001 Tsuji et al. ..... 439/570
6,869,311 B1 * 3/2005 Somura ..... 439/566

FOREIGN PATENT DOCUMENTS

JP 2002-305047 10/2002

* cited by examiner

*Primary Examiner*—Phuong Dinh
(74) *Attorney, Agent, or Firm*—Barley Snyder LLC

(57) ABSTRACT

The surface mounted connector has brackets attached to the ends of an insulating housing along a predetermined direction in such a manner that the brackets can float within a predetermined vertical range, and each bracket has an angled-U-shaped section that passes by an end wall of the insulating housing and interconnects paired side walls of the insulating housing and soldering sections that are provided at the ends of the angled-U-shaped section and are to be soldered to the surface of the circuit board. Each end wall has vertical movement restricting sections that prevent the bracket from vertically moving beyond the predetermined vertical range, and each side wall has, at the ends thereof along the predetermined direction, downward movement restricting sections that prevent the brackets from moving downward beyond the predetermined vertical range.

6 Claims, 5 Drawing Sheets

SURFACE MOUNTING CONNECTOR

FIELD OF THE INVENTION

The present invention relates to a surface mounted connector.

BACKGROUND OF THE INVENTION

In recent years, surface mount technology (SMT) connectors have gained popularity for interconnecting circuit boards because of their ease of electrical connection to elements on circuit boards, their high packaging densities of contacts and other advantages. A SMT connector is electrically connected to a circuit board by soldering a soldering section (that is, a tine section) of a contact thereon to a pad on the surface of the circuit board. Some SMT connectors have a bracket attached to an insulating housing having an array of plural contacts. For example, Japanese Patent Laid-Open No. 2002-305047 describes a SMT connector that is fixed to a circuit board by soldering a bracket, which is attached to the insulating housing by press fitting, to a pad on the surface of the circuit board.

When the surface connector of Japanese Patent Laid-Open No. 2002-305047 is mounted on a surface of a circuit board, if the tine sections of the contacts protrude downward beyond the soldering section of the bracket, an adequate coplanarity is not achieved between the soldering section and the tine sections. Thus, the connector is inadequately fixed to the circuit board. On the other hand, if the soldering section of the bracket protrudes downward beyond the tine sections of the contacts, an adequate coplanarity is also not achieved between the soldering section and the tine sections. In this case, the connector is not adequately connected to the circuit board electrically, although it is adequately fixed to the circuit board.

If the bracket is attached to the housing by press fitting, it is difficult to adjust the level of the bottom of the soldering section and, thus, to achieve a good coplanarity between the soldering section and the tine sections after the attachment. In addition, press fitting of the bracket involves a special tool for press fitting, and thus, the attachment may be difficult. In addition, if press fitting is used, the part of the insulating housing relevant to press fitting has to be made thicker, and the thicker part hinders downsizing of the connector.

SUMMARY OF THE INVENTION

According to an exemplary embodiment of the invention, a surface mounted connector is provided, comprising:

an insulating housing having a mating section extending in a predetermined direction, a pair of end walls disposed at the ends of the mating section along the predetermined direction opposing each other, and a pair of side walls opposing each other and interconnecting the paired end walls;

contacts arranged on the mating section in at least one row along the predetermined direction; and brackets attached to the ends of the insulating housing floating within a predetermined vertical range; the brackets each having an angled-U-shaped section that interconnects the paired side walls and soldering sections that are provided at the ends of the angled-U-shaped section configured to be soldered to the surface of the circuit board;

wherein at least one of the pair of end walls and the pair of sidewalls each having a vertical movement restricting section that prevents the bracket from vertically moving beyond the predetermined vertical range.

DETAILED DESCRIPTION OF THE INVENTION

Now, a surface mounted connector according to an exemplary embodiment of the present invention will be described with reference to the drawings.

The surface mount technology (SMT) connector according to the illustrated embodiment is to be mounted on a surface of a circuit board (not shown) and has a mating section for mating with a counterpart connector.

Figure 1:
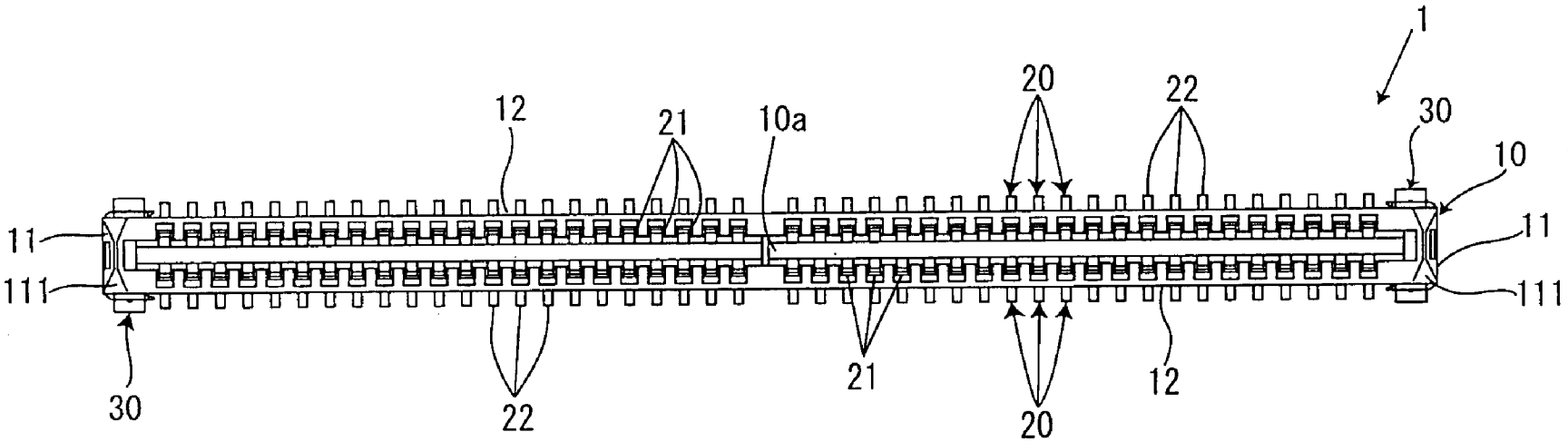
FIG. 1 is a plan view of an SMT connector according to an exemplary embodiment of the present invention.
Figure 2:
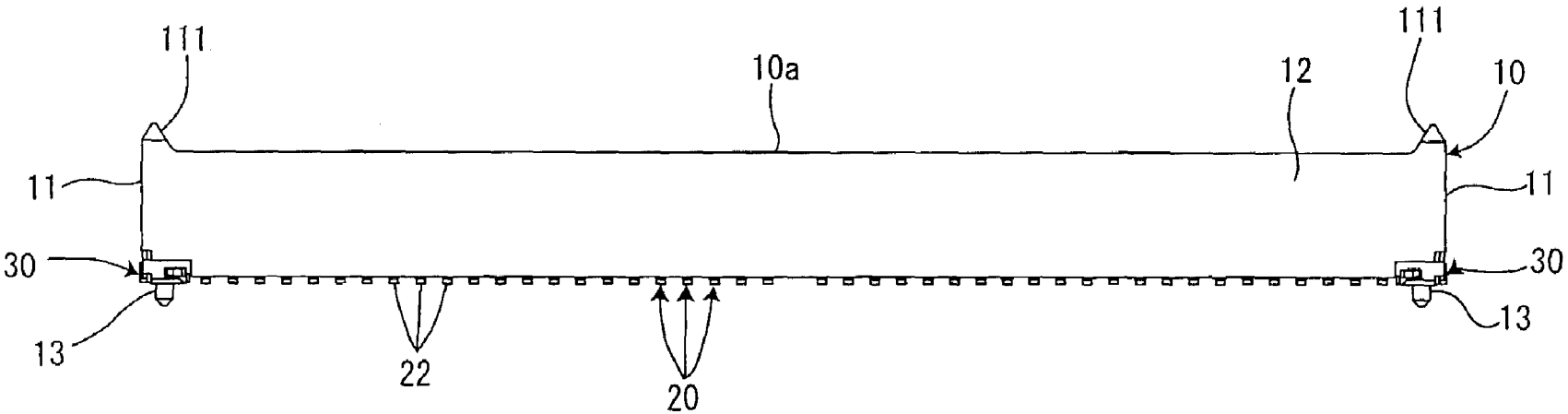
FIG. 2 is a front view of the SMT connector shown in FIG. 1.
Figure 3:
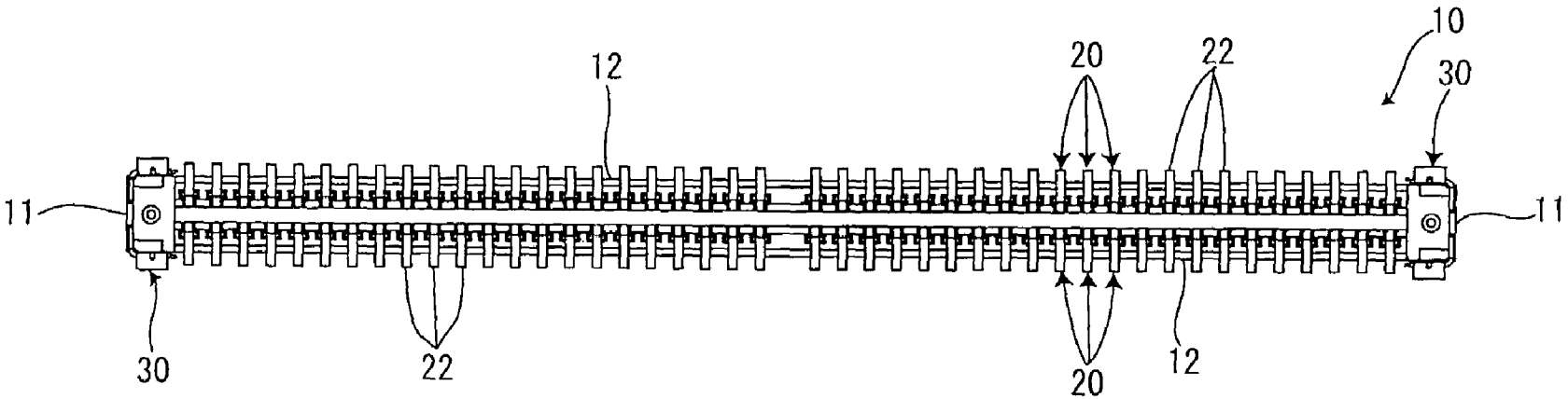
FIG. 3 is a bottom view of the SMT connector shown in FIG. 1.

According to an exemplary embodiment, a SMT connector 1 has an insulating housing 10. The insulating housing 10 shown in FIG. 1 is made of resin and has a mating section 10*a* extending in a predetermined direction (in the horizontal direction in this drawing). A pair of end walls 11 are provided opposing each other at the longitudinal ends of the mating section 10*a* of the insulating housing 10. A pair of side walls 12 oppose each other and interconnect the end walls 11. The paired end walls 11 each have a guiding section 111 for guiding a mating section of the counterpart connector (not shown) to the mating section 10*a* of the SMT connector 1 shown in FIG. 1. As shown in FIG. 2, bosses 13 are provided on the bottom surface of the insulating housing 10 close to the end walls 11, for positioning the SMT connector 1 with respect to the circuit board.

In addition, the SMT connector 1 according to this embodiment has plural contacts 20 on the mating section 10*a*. As shown in FIG. 1, the contacts 20 are arranged in two rows extending in the longitudinal direction. The contacts 20 in one row and the contacts 20 in the other row are arranged to oppose to each other. The contacts 20 are made of a copper alloy and each have a resilient arm section 21 and a tine section 22 to be soldered to the circuit board (not shown). The contacts 20 are attached to the insulating housing 10 by press fitting in such a manner that the arm sections 21 are located toward the mating section 10*a* and the tine sections 22 are located toward the bottom surface of the insulating housing 10, being aligned at their bottoms.

In addition, the SMT connector 1 according to this embodiment has brackets 30 at the bottoms of the ends of the insulating housing 10.

Figure 4:
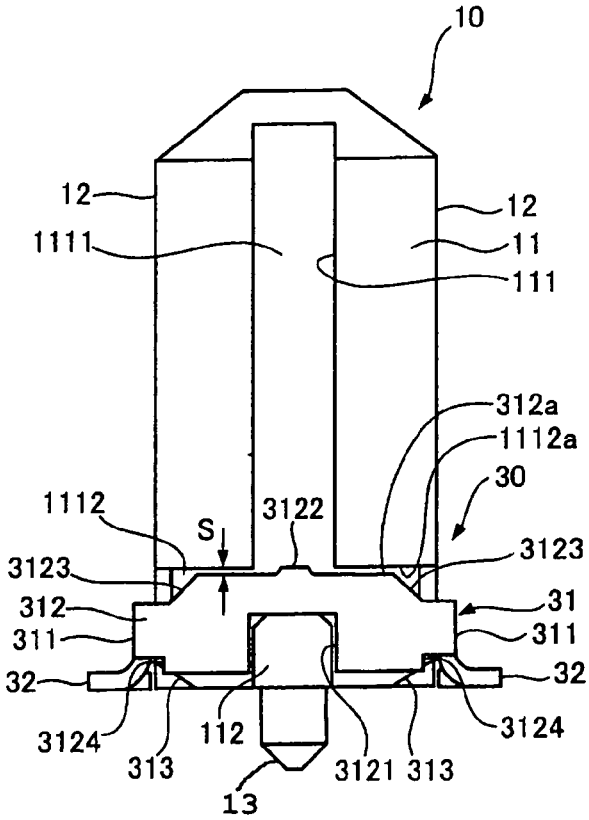
FIG. 4 is an enlarged view of an end wall of the SMT connector shown in FIG. 1.
Figure 5:
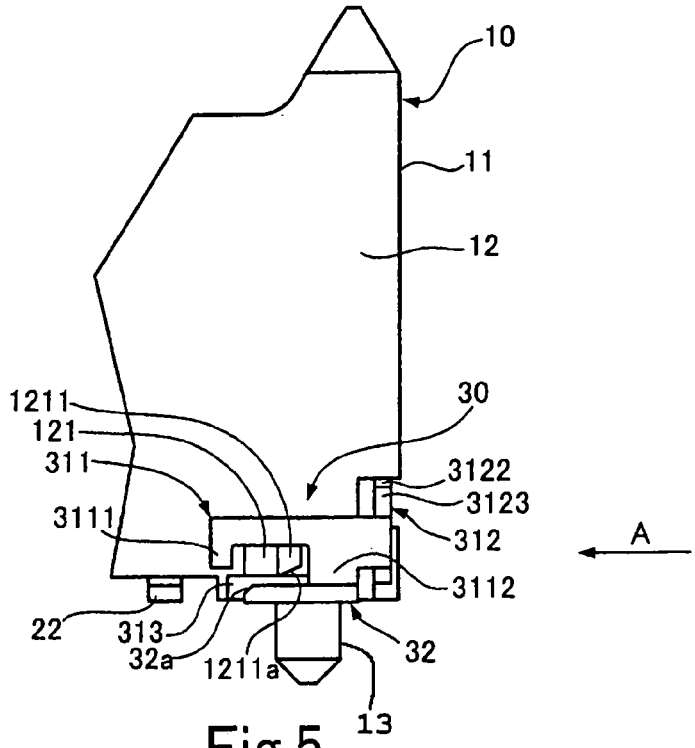
FIG. 5 is an enlarged view of a side wall of the SMT connector shown in FIG. 1 in the vicinity of a right end wall thereof.
Figure 6:
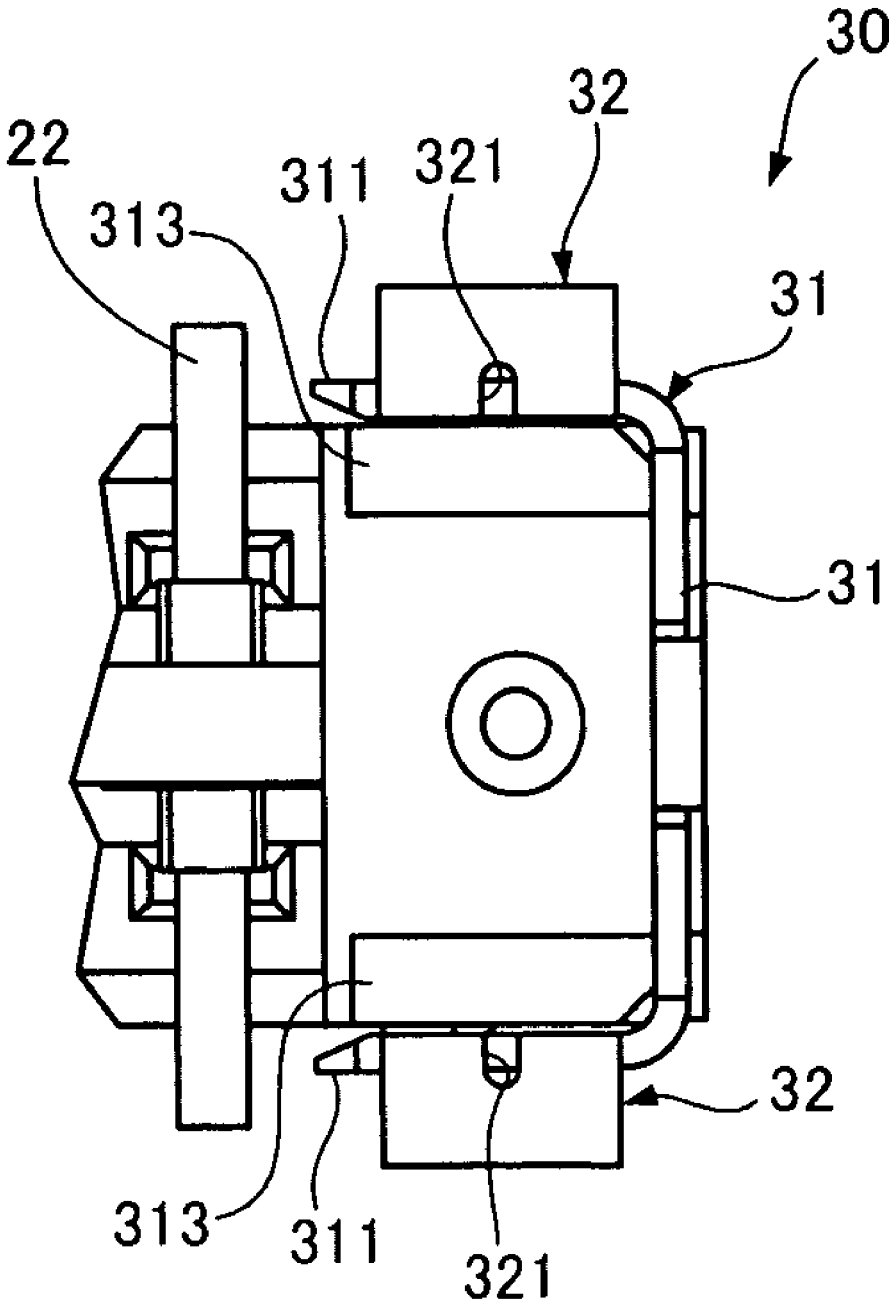
FIG. 6 is an enlarged view of a right end section of the SMT connector shown in FIG. 3.

The brackets 30, as best shown in FIGS. 4–6, each have an angled-U-shaped section 31 and a soldering section 32, and may be formed by bending metal pieces die-cut from one metal plate, for example.

The angled-U-shaped section 31 has a pair of arm sections 311 and a linkage section 312 interconnecting the paired arm sections 311. As shown in FIG. 4, at the middle of the linkage section 312, a rectangular notch 3121 formed in the lower edge, and an upper edge 312*a* of the linkage section 312 has a burr 3122 formed during separation from the carrier above the notch 3121. In addition, step sections 3123 are provided at the upper corners of the linkage section 312 to avoid interference with the leading surface of the counterpart connector to be mated to the SMT connector 1. In addition, step sections 3124 are provided at the lower corners of the linkage section 312. Thus, the ends of the linkage sections 312 are tapered because of the step sections 3123, 3124. The paired arm sections 311 are resilient and extend from the tapered ends of the linkage section 312. As shown in FIG. 5, the tip end of the arm section 311 is shaped into a letter L rotated clockwise by about 90 degrees, so that the arm section 311 has a free end section 3111 bent downward at the tip end. Between the tip end of the arm section 311 and the end thereof close to the linkage section 312, there is provided a connection section 3112 that is connected to the soldering section 32.

The soldering section 32, which is to be soldered to the surface of the circuit board, has a rectangular shape and is bent perpendicularly to the connection section 3112 of the angled-U-shaped section 31 by about 90 degrees. As shown in FIG. 5, an upper edge 32*a* of the soldering section 32 close to the free end section 3111 is chamfered. In addition, as shown in FIG. 6, the soldering section 32 has an opening 321 to facilitate bending.

As shown in FIG. 4, an inverted-T-shaped groove 111 is formed in the end wall 11 of the insulating housing 10, and a substantially rectangular protrusion 112 is formed at the middle of the lower end of the groove. The upper two corners of the protrusions 112 are chamfered. A vertically extending section 1111 of the inverted-T-shaped groove 111 shown in FIG. 4 is to accommodate a molding pin for molding the protrusion 112. As shown in FIG. 4, the burr 3122 on the linkage section 312 aligns with the vertically extending section 1111 of the inverted T-shaped groove 111. As shown in FIG. 5, the side wall 12 also has a protrusion 121, with a wall 1211 thereof close to the end wall 11 chamfered, at the lower end in the vicinity of the end wall 11. Furthermore, the chamfered wall 1211 has a notch at a lower corner 1211*a* close to the end wall 11.

The bracket 30 is disposed in such a manner that the angled-U-shaped section 31 connects the protrusions 121 on the both side walls 12 and the protrusion 112 on the end wall 11 to each other. That is, the bracket 30 is attached to the insulating housing 10 by fitting the angled-U-shaped section 31 into a horizontally extending section 1112 of the inverted-T-shaped groove 111 shown in FIG. 4 from the side of the end wall 11 (see the arrow A shown in FIG. 5). When attaching the bracket 30 to the insulating housing 10, first, the free end section 3111 of the bracket 30 is moved along the side wall 12. With the free end section 3111 being guided by the chamfered wall 1211 of the protrusion 121 on the side wall 12, the arm section 311 is temporarily deflected away from the side wall 12. In this process, the soldering section 32 is less deflected, so that the upper edge 32*a* of the soldering section 32 would otherwise interfere with the protrusion 121 on the side wall 12. However, according to this embodiment, since the lower corner 1211*a* of the protrusion 121 is notched, and the upper edge 32*a* of the soldering section 32 is chamfered, any interference between the soldering section 32 and the protrusion 121 is prevented. If the bracket 30 is pushed further in the direction indicated by the arrow in FIG. 5, the free end section 3111 passes over the protrusion 121, and thus, the deflection of the arm section 311 is eliminated, so that the arm section 311 is fitted onto the protrusion 121 from the outside. Besides, when the arm section 311 reaches this state, the notch 3121 formed in the linkage section 312 of the bracket 30 is fitted onto the protrusion 112 on the end wall 11 from the outside. This is a state where the attachment of the bracket 30 is completed. In this way, the bracket 30 is attached to the insulating housing 10 without press fitting. Thus, the attachment requires no special tool for press fitting and is easy for anyone to accomplish. Furthermore, if press fitting were used, the part of the insulating housing 10 relevant to press fitting would have to be made thicker. However, the need for the thicker part is eliminated, so that the insulating housing 10 has a smaller size. Furthermore, the insulating housing 10 can be shaped only with a simple mold.

As shown in FIG. 4, there is a gap S between the upper edge 312*a* of the linkage section 312 of the bracket 30 thus attached and an upper edge 1112*a* of the horizontally extending section 1112 of the inverted-T-shaped groove 111. The bracket 30, which is simply fitted from the side of the end wall 11 rather than being fixed to the insulating housing 10 by press fitting or the like, can float by the distance of the gap S. That is, the bracket 30 can move upward until the upper edge 312*a* of the linkage section 312 comes into contact with the upper edge 1112*a* of the horizontally extending section 1112 of the inverted-T-shaped groove 111. Once the upper edge 312*a* of the bracket 30 comes into contact with the upper edge 1112*a* on the side of the insulating housing, the upper edge 1112*a* on the side of the insulating housing prevents the bracket 30 from moving further upward. Furthermore, the bracket 30 attached to the insulating housing 10 is prevented from moving downward by the protrusion 112 on the end wall 11 and the protrusions 121 on the side walls 12. Therefore, the combination of the upper edge 1112*a* and the protrusion 112 on the side of the insulating housing, which are provided on the end wall 11, correspond to a vertical movement restricting section according to the present invention, and the protrusions 121 on the side walls 12 correspond to a downward movement restricting section according to the present invention.

The bracket 30 shown in the drawings has moved downward under its own weight, and the notch 3121 in the linkage section 312 is in contact with the protrusion 112 on the end wall 11, and the part of each arm section 311 extending between the connection section 3112 and the free end section 3111 is in contact with the protrusion 121 on the side wall 12. Thus, the bracket 30 cannot move further downward, and the bottom of the soldering section 32 of the bracket 30 in this state protrudes downward slightly beyond the bottom of the tine sections 22 of the contacts 20. In mounting the SMT connector 1 according to this embodiment onto the circuit board (not shown), when the soldering section 32 comes into contact with a pad on the circuit board, the bracket 30 moves upward until the bottom of the soldering section 32 reaches the same level as the bottom of the tine sections 22. That is, in mounting of the SMT connector 1 according to this embodiment, a good coplanarity is achieved between the tine sections 22 and the soldering section 32, and both reliable electrical connection between the connector 1 and the circuit board by the tine sections 22 and reliable fixing of the connector 1 to the circuit board by the soldering section 32 are assured. Furthermore, even if there is a force to remove the SMT connector 1 from the circuit board, the protrusions 112, 121 prevents the brackets 30 from being detached from the insulating housing 10.

In addition, as shown in FIGS. 4, 5 and 6, a part of the bottom of the insulating housing which extends along the soldering section 32 has a chamfered section 313. The chamfered section 313 is intended to provide a space for accommodating an excess of solder applied to the soldering section 32.

I claim:

1. A surface mounted connector, comprising:

an insulating housing having a mating section extending in a predetermined direction, a pair of end walls disposed at the ends of the mating section along the predetermined direction opposing each other, and a pair of side walls opposing each other and interconnecting the paired end walls;

contacts arranged on the mating section in at least one row along the predetermined direction; and brackets attached to the ends of the insulating housing floating within a predetermined vertical range; the brackets each having an angled-U-shaped section that interconnects the paired side walls and soldering sections that are provided at the ends of the angled-U-shaped section configured to be soldered to the surface of the circuit board;

wherein at least one of the pair of end walls and the pair of sidewalls each having a vertical movement restricting section that prevents the bracket from vertically moving beyond the predetermined vertical range.

2. The surface mounted connector according to claim 1, wherein:

the end walls each have a vertical movement restricting section that prevents the bracket from vertically moving beyond the vertical range; and the side walls each have, at the ends thereof along the predetermined direction, downward movement restricting sections that prevent the brackets from moving downward beyond the predetermined vertical range.

3. The surface mounted connector according to claim 2, wherein the movement restricting section on the end walls is a protrusion integral with the end wall.

4. The surface mounted connector according to claim 2, wherein the movement restricting section on the side walls is a protrusion integral with the end wall.

5. The surface mounted connector according to claim 3, wherein the movement restricting section on the side walls is a protrusion integral with the end wall.

6. The surface mounted connector according to claim 4, wherein the angled-U-shaped section passes by the end wall and interconnects the paired side walls.

* * * * *